United States Patent [19]

Ondrasik, II

[11] 4,064,994

[45] Dec. 27, 1977

[54] DEFLECTION-RESISTANT RACK

[76] Inventor: Vladimir J. Ondrasik, II, 17044 Westbury Drive, Granada Hills, Calif. 91344

[21] Appl. No.: 698,896

[22] Filed: June 23, 1976

[51] Int. Cl.[2] ..... A47F 5/00

[52] U.S. Cl. ..... 211/153; 211/181

[58] Field of Search ..... 211/153, 181, 184; 108/153, 156, 137, 144, 148; 126/332, 337 R, 337 A; 312/351, 346

[56] References Cited

U.S. PATENT DOCUMENTS

| | | | |
|---|---|---|---|
| 1,872,733 | 8/1932 | Greenwald | 126/337 R |
| 2,110,726 | 3/1938 | Harvey | 211/153 |
| 2,834,334 | 5/1958 | Bill | 126/337 A X |
| 3,316,864 | 5/1967 | Maslow | 108/148 |
| 3,523,508 | 8/1970 | Maslow | 211/181 X |
| 3,784,044 | 1/1974 | Bruggeman et al. | 211/181 X |

*Primary Examiner*—Roy D. Frazier
*Assistant Examiner*—Terrell P. Lewis
*Attorney, Agent, or Firm*—Verbeck and Haller

[57] ABSTRACT

An improved deflection-resistant rack designed to reduce the amount of deflection suffered by a rack because of weight being supported therewith. The rack strength achieved by this invention is the result of a design which utilizes each element of the improved rack as an integral member of its spaced double-bar construction. Frequently elements of the improved rack serve in multi-functional capacities within the improved rack design.

8 Claims, 6 Drawing Figures

DEFLECTION-RESISTANT RACK

BACKGROUND OF THE INVENTION

1. Field of the Invention

This invention relates to an improved rack for supporting articles placed thereon. This invention is especially suited to support heavier objects while keeping the rack itself as light as possible.

2. Description of Prior Art

Racks are often used whenever it is desirable to have a platform on which various articles can be supported. Racks are often fabricated of common round wire rod with a rectangular structural perimeter member and a number of smaller support members attached to either the front and rear members of the structural perimeter member (longitudinal direction) or to opposite sides of the structural perimeter member (transverse direction). Generally these racks are supported by resting the rack on its structural perimeter member.

A common problem encountered by rack users is that, as the size of the rack increases and as the weight of articles placed thereon increases, the rack itself suffers either or both a longitudinal deflection (a deflection from front to rear) or a transverse deflection (a deflection from side-to-side). Traditional methods of overcoming this problem include the utilization of larger structural perimeter members and support members. Frequently additional side-to-side structural members are T welded to the inside edges of the structural perimeter member to increase strength by adding more structure to the rack. U.S. Pat. Nos. 2,110,726 and 2,225,991 show one application of such an approach. Additionally, longitudinal structural members are spaced across and welded to the bottom of the front and rear sides of the structural perimeter member and the transverse structural members where they intersect to form a grid. While these methods of increasing rack strength do work, they also add considerable weight to the rack which makes it correspondingly more difficult to handle.

Of the rack designs with which I am familiar, none utilize the spaced double-bar construction as embodied in this invention. However, British Pat. No. 929,071 does show a pair of rectangular wire frames separated by spaced parallel wires but teaches that the sides of such racks are resilient for insertion into mating brackets. At best, any interpretation would recognize only limited deflection resistance in one direction, the transverse direction.

Additional techinques used to add strength to large racks include the attachment of metal bars of rectangular cross section, with the larger dimension parallel to the plane of deflection of the rack and positioned against the structural perimeter member in perpendicular relation to the support members. Another rack design uses metal balls as spacing elements between the structural perimeter member and a structural member to develop added strength in the correspondeing direction. However, both of these approaches require the use of nonstandard forms of materials, specifically metal bars and metal balls, which necessarily require special handling during fabrication.

Another deficiency of the prior art devices is that their design requires the use of a combination welding techniques in the fabrication of the rack rather than the use of a standardized welding technique which would facilitate the construction of the rack. Conventional racks require combination of butt welds, T welds, and lapp welds, whereas my invention uses almost exclusively the lapp weld.

The prior art devices with which I am familiar do not provide adequate strength and resistance to deflection for both the longitudinal and transverse directions in a light weight rack design. Further, I am not aware of any prior art device which incorporate the spaced double-bar design with other than metal ball spacers. Nor have I observed any rack design which utilizes the elements of the rack in multi-functional capacities. Those racks which do provide additional strength features are difficult to fabricate because of the use of nonstandard materials. Also, prior art racks have not standardized their method of welding the various members of the rack to one another.

SUMMARY OF THE INVENTION

This invention relates to an improved rack whose particular design and construction uniquely adapts it to support weight placed thereon with a high resistance to rack deflection. The configuration of the improved rack develops this resistance to deflection in both the longitudinal and transverse directions. The cooperation of every element of the rack as an integral member of the improved rack's spaced double-bar design produces the deflection resistance at a substantially lower overall rack weight. This invention describes an improved rack which is fabricated almost exclusively with lapp welds, providing a rack which is considerably less difficult and expensive to produce.

An object of this invention is to provide a light weight rack which demonstrates a high-resistance rack deflection.

A further object of this invention is to provide a rack which incorporates the benefits of a spaced double-bar design to achieve high resistance to rack deflection.

A further object of this invention is to provide a rack which uses every element in the rack as an integral member of the spaced double-bar design.

A further object of this invention is to provide a rack which does not require the use of construction materials other than basic round wire rod.

A further object of this invention is to provide a rack which is fabricated by the use of a standardized welding technique.

BRIEF DESCRIPTION OF THE DRAWINGS

The following is a brief description of the accompanying drawings.

DESCRIPTION OF THE PREFERRED EMBODIMENTS

Figure 1:
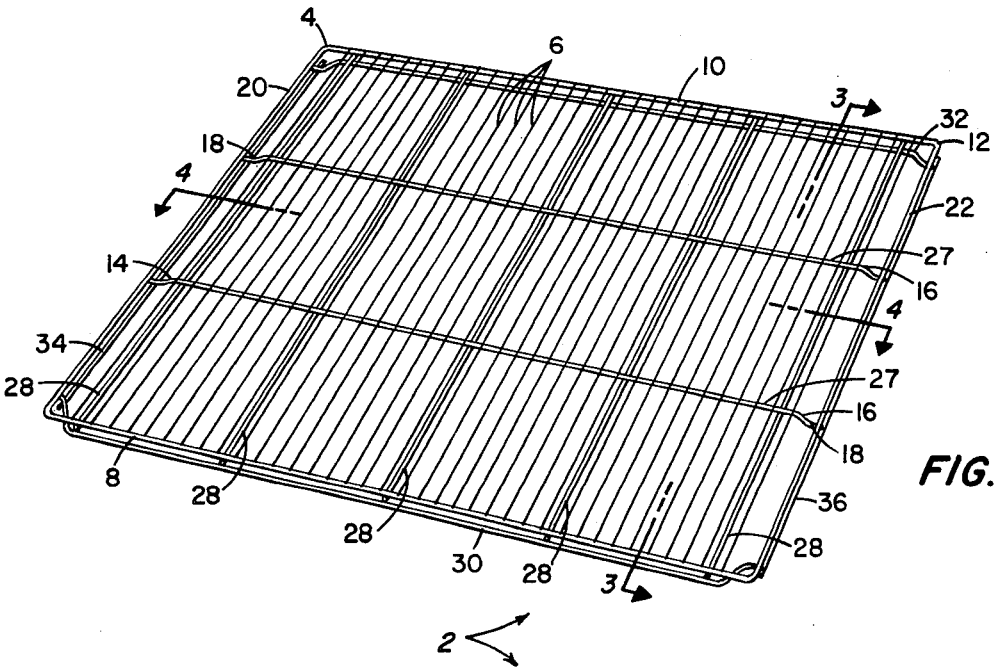
FIG. 1 is an oblique view of the improved rack embodying the invention.

FIG. 1 of the drawings shows the improved rack 2 embodying the invention. An endless rectangular structural perimeter member 4 is prepared by butt welding a wire rod into the proper rectangular shape. The butt weld required to prepare the structural perimeter member 4 is the only nonstandard weld used in the fabrication of this invention. All other welds required by this invention are lapp-type welds, which generally are easier to perform and can generally be accomplished on the same machine.

A plurality of smaller sized, evenly spaced parallel support members 6 are welded to the top edges of the front 8 and rear 10 members of the structural perimeter member 4. This combination of structural perimeter member 4 and support members 6 constitute the basic rack member 12 to which is added a deflection-resistant frame 14.

The deflection-resistant frame 14 consists of a combination of structural elements which can be fabricated as a unit and then attached to the rack member 12 or, conversely, the various structural elements can be attached to the rack member 12 in sequence to form the deflection-resistant frame 14 thereon. To assist in understanding the cooperation among the various elements of the improved rack 2, this description is presented in the same manner as if the deflection-resistant frame 14 were being suquentially formed on the rack member 12, and not as a separate unit which is subsequently attached to the rack member 12.

A plurality of evenly spaced cross members 16 with their outer ends 18 being bent downwardly and outwardly are welded to the bottom edges of the left 20 and right 22 members of the structural perimeter member 4. The cross members 16 are prepared so that, when attached to the structural perimeter member 4, the top edges 24 of the cross members 16 are in substantially the same plane as the bottom edges 26 of the support members 6. The cross members 16 are also welded to the support members 6 at their intersections 27. A plurality of evenly spaced longitudinal members 28 are welded to the bottom edges of, and in perpendicular relation to, the cross members 16 and the front 8 and rear 10 members of the structural perimeter member 4. The longitudinal members 28 are in parallel relation to the support members 6.

The particular configuration of support members 6 being spaced away from the longitudinal members 28 by the cross members 16 exhibits the structural characteristics of a spaced double-bar design over the plane of the rack member 12 which thereby forms a deflection-resistant support structure.

The general features of a spaced double-bar design include an upper member, a parallel lower member, and a set of spacing elements therebetween. Characteristic of such a design is that the force required to bend or deflect the combination, in a plane perpendicular to that defined by upper and lower members, is approximately the sum of the forces required to bend upper member and lower member separately. Conversely, however, the force required to bend or deflect the combination, in a plane parallel to that defined by the upper and lower members, is substantially larger than the sum of the forces required to bend both. Correspondingly, the support members 6 (serving as a set of cooperating upper members), the cross members 16 (serving as spacing elements between the upper members and the lower members), and the longitudinal member 28 (serving as a set of cooperating lower members) resist deflections of the rack in the longitudinal front-to-rear) direction.

It is important to observe that the advantages inherent in the use of the cross members 16 over the use of metal balls as the spacing element are that it is substantially easier to fabricate the rack with cross members 16 than it would be with numerous little metal balls, and that the cross members 16 themselves provide support against deflections in the transverse (side-by-side) direction which metal ball spacers would be incapable of providing.

Additional rack strength is achieved by adding a frontal member 30 and a back member 32. The ends of the frontal member 30 are bent rearwardly and upwardly, and outwardly so that, when welded to the rack 2, the ends of the frontal member 30 or are welded to the bottom edges of the forward ends of the left member 20 and right member 22, respectively, and the body of the frontal member 30 is in spaced alignment with the front member 8 of the structural perimeter member 4 with the frontal member 30 being welded to the bottom edged of the forward ends of the longitudinal members 28. Similarly, the ends of the back member 32 are bent forwardly and upwardly, and outwardly so that, when welded to the rack 2, the ends of the back member 32 are welded to the bottom edges of the rear ends of the left member 20 and right member 22, respectively, and the body of the back member 32 is in spaced alignment with the rear member 10 of the structural perimeter member 4 with the back member 32 being welded to the bottom edges of the rear ends of the longitudinal members 28. The particular configuration of elements described above produces, respectively, a deflection-resistant frontal structure and a deflection-resistant rear structure.

Further, this configuration, which provides for the front member 8 of the structural perimeter member 4 being spaced away from the frontal member 30 by the forward ends of longitudinal members 28, and the rear member 10 of the structural perimeter member 4 being spaced away from the back member 32 by the rear ends of the longitudinal members 28, exhibits the structural characteristics of the spaced double-bar design. Both the deflection-resistant frontal structure and the deflection-resistant rear structure resist deflections of the rack 2 in the transverse (side-to-side) direction. Further, it is important to observe and recognize the multi-functional capacities of various elements within the rack 2.

First, not only does each element of the rack 2 provide the support inherent in the fact that it is a cooperating member of the rack, but also the longitudinal members 28, for example, cooperate as the lower members of the deflection-resistant support structure and, in addition, as the spacing elements of the deflection-resistant frontal structure and the deflection-resistant rear structure.

Further, the front member 8 of the structural perimeter member 4 acts not only as a spacing element of the deflection-resistant support structure but also as the upper member of the deflection-resistant frontal structure. Similarly, the rear member 10 of the structural perimeter member 4 acts not only as a spacing element of the deflection-resistant support structure but also as the upper member of the deflection-resistant rear structure.

Additionally, FIG. 1 shows a left side member 34 and a right side member 36. The left side member 34 is welded to the bottom edges of the left ends of the frontal member 30, the cross members 16, and the back member 32 so that the left side member 34 is in spaced alignment with the left member 20 of the structural perimeter member 4. The right side member 36 is welded to the bottom edges of the right ends of the frontal member 30, the cross members 16, and the back member 32 so that the right side member 36 is in spaced alignment with the right member 22 of the structural perimeter member 4. The particular configuration of elements described above produces, respectively, a deflection-resistant left structure and a deflection-resistant right structure.

Again, this configuration of elements which make up the deflection-resistant left structure and the deflection-resistant right structure exhibits the structural characteristics of the spaced double-bar design. Both the deflection-resistant left structure and the deflection-resistant right structure resist deflections of the rack 2 in the longitudinal (front-to-back) direction.

It is again important to observe the multi-functional capacities of various elements within the rack 2. The frontal member 30 serves not only as the lower member for the deflection-resistant frontal structure but also its ends serve, respectively, as spacing elements for the deflection-resistant left structure and the deflection-resistant right structure. The back member 32, similary, serves not only as the lower member for the deflection-resistant rear structure but also its ends serve, respectively, as spacing elements for the deflection-resistant left structure and the deflection-resistant right structure.

The cross members 16 serve not only as spacing elements for the deflection-resistant support structure but also its ends serve, respectively, as spacing elements for the deflection-resistant left structure and the deflection-resistant right structure.

Figure 2:
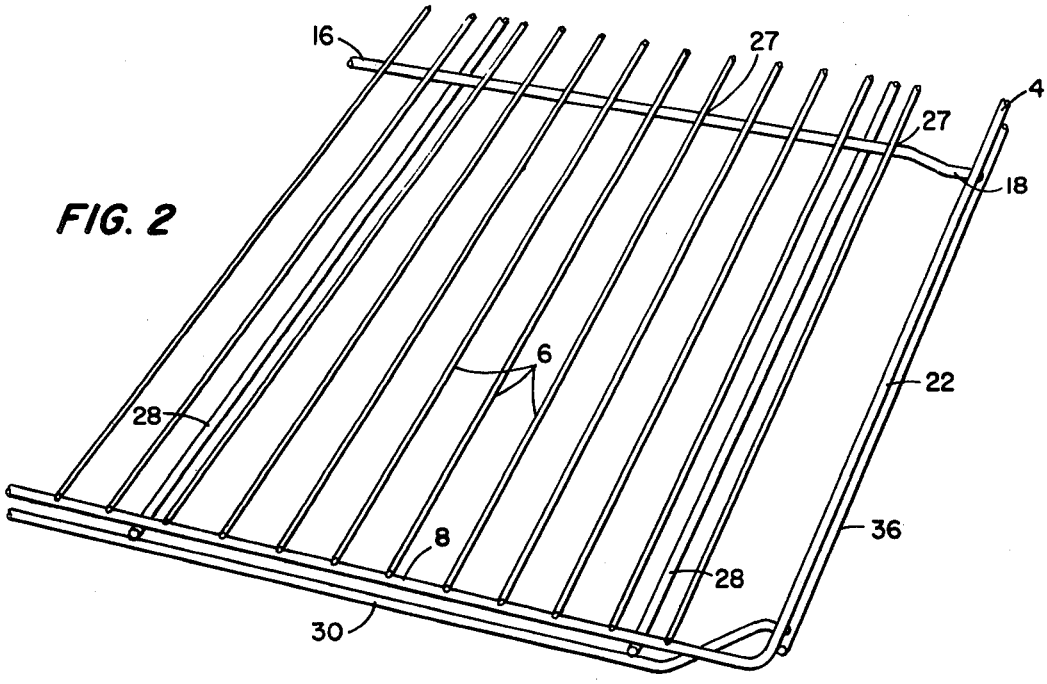
FIG. 2 is an oblique view, partially in section, of one corner of the improved rack.

FIG. 2 shows an enlarged section of one corner of the improved rack 2. The details of the cooperation between the support members 6, the front member 8, and the right member 22 of the structural perimeter members 4, the cross members 16, the longitudinal member 28, the frontal member 30, and the right side member 36 can be more readily observed. Of particular interest is the manner in which the end of the cross member 16 is bent downwardly and outwardly so that it can be welded to the bottom edges of the support members 6 and the right member 22 of the structural perimeter member 4. Of further interest is the manner in which the end of the frontal member 30 is bent rearwardly and upwardly, and outwardly so that the body of the frontal member 30 is in spaced alignment with the front member 8 of the structural perimeter member 4 while the end of the frontal member 30 is attached to the bottom edge of the right member 22 of the structural perimeter member 4. Of further interest is the cooperation between the cross members 16 and the longitudinal members 28.

Figure 3:
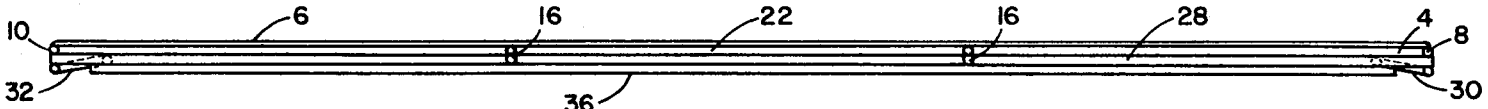
FIG. 3 is a cross section of the improved rack taken at approximately 3—3 of FIG. 1.

FIG. 3 shows a longitudinal (front-to-rear) section of the rack 2. The orientation of this figure shows a view of the rack 2 which is perpendicular to the deflection-resistant frontal structure and the deflection-resistant rear structure and which is parallel to the deflection-resistant support structure and deflection-resistant right structure.

Figure 4:
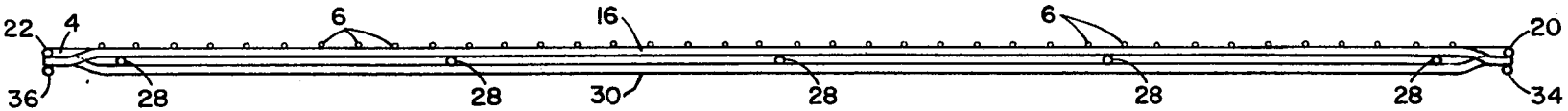
FIG. 4 is a cross section of the improved rack taken at approximately 4—4 of FIG. 1.

FIG. 4 shows a view of the rack 2 which is parallel to the deflection-resistant frontal structure and which is perpendicular to the deflection-resistant support structure, the deflection-resistant left structure, and the deflection-resistant right structure.

Figure 5:
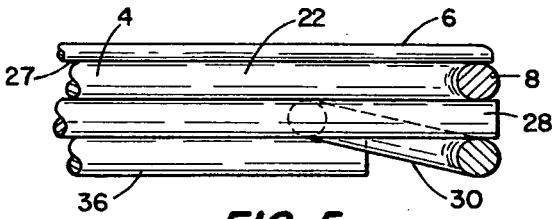
FIG. 5 is an enlarged partial section of the front end of the improved rack taken at approximately 3—3 of FIG. 1.
Figure 6:
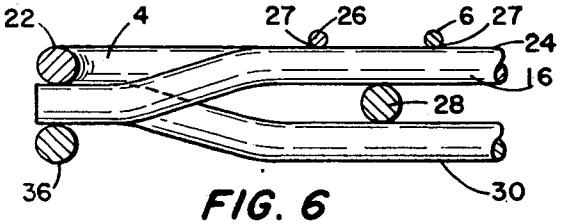
FIG. 6 is an enlarged partial section of the left end of the improved rack taken at approximately 4—4 of FIG. 1.

FIG. 5 and FIG. 6 are enlargements of the ends of FIG. 3 and FIG. 4, respectively. FIG. 5 and FIG. 6 clearly show the general features of the spaced double-bar design which includes an upper member, a lower member, and a set of spacing elements.

The inclusion of the features of the spaced double-bar design for both the longitudinal and transverse directions on the improved rack 2 provides a significant increase in the rack's performance, supporting weight without deflection, while producing an overall lighter weight rack.

The concept of the invention allow for a second (third, etc.) deflection-resistant frame to be disposed below and attached to the first deflection-resistant frame 14.

While variations of this concept could easily be developed, the precise structure described above is considered best for fabricating the improved rack.

Using the above description, those skilled in the particular art of rack fabrication could easily contruct this or variant forms of the improved rack. Such variant forms are to be considered within the scope and essence of this invention.

What is claimed is:

1. A deflection-resistant rack comprising:

a rack member having an endless rectangular structural perimeter member with integral front, rear, left and right members, and a plurality of evenly spaced parallel support members disposed above and rigidly attached to the front and rear members of the structural member; and a deflection-resistant frame having a plurality of spaced cross-members and a plurality of spaced longitudinal members whereby said spaced longitudinal members are rigidly attached to the bottom of, and in perpendicular relation to, the cross members, the deflection-resistant frame is attached to the bottom of the rack member, the ends of the longitudinal members being attached to the bottom of the front and rear members of the structural member and the ends of the cross-members being attached to the bottom of the left and right members of the structural member such that the longitudinal members of the deflection-resistant frame are in parallel relation to the support members, the ends of the cross-members are bent downwardly and outwardly such that the top edges of the body of the cross-member are in substantially the same plane as the bottom edges of the support member, the cross members being rigidly attached to the support member whereby to form a space double-bar deflection-resistant support structure.

2. A deflection-resistant rack, as recited in claim 1, wherein the deflection-resistant frame further comprises:

a frontal member having both ends thereof bent rearwardly and upwardly, and outwardly, said frontal member being disposed below and rigidly attached to the forward ends of the longitudinal members such that the ends of the frontal member are disposed below and attached to the left and right members of the structural member, the body of the frontal member being substantially in spaced alignment with the front member of the structural member with the forward ends of the longitudinal members spacing the frontal member away from the front member of the structural member whereby to form a space double-bar deflection-resistant frontal structure; and a back member having both ends thereof bent forwardly and upwardly, and outwardly, said back member disposed below and rigidly attached to the rear ends of the longitudinal members such that the ends of the back member are disposed below and attached to the left and right members of the structural member, the body of the back member being substantially in spaced alignment with the rear member of the structural member with the rear ends of the longitudinal members spacing the back member away from the rear member of the structural member whereby to form a space double-bar deflection-resistant rear structure.

3. A deflection-resistant rack as recited in claim 2, wherein the deflection-resistant frame further comprises:

a left side member disposed below and rigidly attached to the left ends of the cross-member, the left end of the frontal member, and the left end of the back member, such that the left side member is substantially in spaced alignment with the left member of the structural member whereby to form a space double-bar deflection-resistant left structure; and a right side member disposed below and rigidly attached to the right ends of the cross-members, the right end of the frontal member, and the right end of the back member, such that the right side member is substantially in spaced alignment with the right member of the structural member whereby to form a space double-bar deflection-resistant right structure.

4. A deflection-resistant rack as recited in claim 1, wherein the support members are attached to the structural member; and the cross-members are attached to the longitudinal member; and the deflection-resistant frame is attached to the rack member by lapp-welding.

5. A deflection-resistant rack as recited in claim 3, wherein the support members are attached to the structural member; and the cross-members are attached to the structural member; and the longitudinal members are attached to the structural members; and the frontal member is attached to the forward ends of the longitiudinal members and to the left and right members of the structural member; and the back member is attached to the rear ends of the longitudinal members and to the left and right members of the structural member; and the left side member is attached to the left ends of the cross-members, the left end of the frontal member, and left end of the back member; and the right side member is attached to the right ends of the cross-member, the right end of the frontal member, and right end of back member by lapp-welding.

6. A deflection-resistant rack comprising:

a rack member having an endless rectangular structural perimeter member with integral front, rear, left, and right members, and a plurality of evenly spaced parallel support members disposed above and rigidly attached to the front and rear members of the structural member; and a deflection-resistant frame having a plurality of spaced cross-members and a plurality of spaced longitudinal members whereby said spaced longitudinal member are rigidly attached to the bottom of, and in perpendicular relation to, the cross-member, the deflections-resistant frame is attached to the bottom of the rack member, the ends of the longitudinal members being attached to the bottom of the front and rear members of the structural member and the ends of the cross-members being attached to the bottom of the left and right members of the structural member such that the longitudinal members of the deflection-resistant frame are in parallel relation to the support members, the ends of the cross-members are bent downwardly and outwardly such that the top edges of the body of the cross-members are in substantially the same plane as the bottom edges of the support members, the cross-members being rigidly attached to the support members whereby the support members, the longitudinal members, and the front and rear members and the cross-members form a space double-bar deflection-resistant support structure such that the support members exhibit the structural characteristics of the upper element of the space double-bar deflection-resistant support structure, the longitudinal members exhibit the structural characteristics of the lower element of the space double-bar deflection-resistant support structure, and the front and rear members and the cross-members exhibit the structural characteristics of the spacing elements of the space double-bar deflection-resistant support structure.

7. A deflection-resistant rack, as recited in claim 6, wherein the deflection-resistant frame further comprises:

a frontal member having both ends thereof bent rearwardly and upwardly, and outwardly, said frontal member being disposed below and rigidly attached to the forward ends of the longitudinal members such that the ends of the frontal member are disposed below and attached to the left and right members of the structural member, the body of the frontal member being substantially in spaced alignment with the front member of the structural member with the forward ends of the longitudinal members spacing the frontal member away from the front member of the structural member whereby the front member, the forward ends of the longitudinal members, and the front member form a space double-bar deflection-resistant frontal structure such that the front member exhibits the structural characteristics of the upper element of the space double-bar deflection-resistant frontal structure, the frontal exhibits the structural characteristics of the lower element of the space double-bar deflection-resistant frontal structure and the forward ends of the longitudinal members exhibit the structural characteristics of the spacing elements of the space double-bar deflection-resistant frontal structure; and a back member having both ends thereof bent forwardly and upwardly, and outwardly, said back member being disposed below and rigidly attached to the rear ends of the longitudinal members such that the ends of the back member are disposed below and attached to the left and right members of the structural member, the body of the back member being substantially in speed alignment with the rear member of the structural member with the rear ends of the longitudinal members spacing the back member away from the rear member of the structural member whereby the back member, the rear member and the rear ends of the longitudinal members form a space double-bar deflection-resistant rear structure such that the rear member exhibits the structural characteristics of the upper element of the space double-bar deflection-resistant rear structure, the back member exhibits the structural characteristics of the lower element of the space double-bar deflection-resistant rack structure, and the rear ends of the longitudinal members exhibit the structural characteristics of the spacing elements of the space double-bar deflection-resistant rear structure.

8. A deflection-resistant rack as recited in claim 7 wherein the deflection-resistant frame further comprises:

a left side member disposed below and rigidly attached to the left ends of the cross-members, the left end of the frontal member, and the left end of the back member, such that the left side member is substantially in spaced alignment with the left member of the structural member whereby the left member, the left side member, and the left ends of the cross-members, the left end of the frontal member, and the left end of the back member form a space double-bar deflection-resistant left structure, such that the left member exhibits the structural characteristics of the upper element of the space double-bar deflection-resistant left structure, the left side member exhibits the structural characteristics of the lower element of the space double-bar deflection-resistant left structure and the left ends of the cross-members, the left end of the frontal member, and the left end of the back member, exhibit the structural characteristics of the spacing elements of the space double-bar deflection-resistant left structure; and a right side member disposed below and rigidly attached to the right ends of the cross-members, the right end of the frontal member, and the right end of the back member, such that the right side member is substantially in spaced alignment with the right member of the strcutural member whereby the right member, the right side member, and the right ends of the cross-members, the right end of the frontal member, and the right end of the back member form a space double-bar deflection-resistant right structure, such that the right member exhibits the structural characteristics of the upper element of a space double-bar deflection-resistant right structure, the right side member exhibits the structural characteristics of the lower element of the spaced double-bar deflection-resistant right structure, and the right ends of the cross-members, the right end of the frontal member, and the right end of the back member exhibit the structural characteristics of the spacing elements of the space double-bar deflection-resistant right structure.

* * * * *